United States Patent [19]

Solomon

[11] 4,189,082

[45] Feb. 19, 1980

[54] GLAZIER'S POINT DRIVER

[76] Inventor: Sydney H. Solomon, 1 Wimbleton La., Great Neck, N.Y. 11023

[21] Appl. No.: 943,845

[22] Filed: Sep. 18, 1978

[51] Int. Cl.[2] ..... B25C 1/00

[52] U.S. Cl. ..... 227/109; 227/119; 227/146

[58] Field of Search ..... 227/119, 120, 132, 146, 227/109, 135

[56] References Cited

U.S. PATENT DOCUMENTS

| | | | |
|---|---|---|---|
| 1,134,334 | 4/1915 | Hartley | 227/120 |
| 1,744,700 | 1/1930 | Hubbard et al. | 227/132 |

FOREIGN PATENT DOCUMENTS

| | | | |
|---|---|---|---|
| 2534878 | 2/1978 | Fed. Rep. of Germany | 227/132 |
| 1376987 | 9/1964 | France | 227/132 |

*Primary Examiner*—Paul A. Bell

*Attorney, Agent, or Firm*—Allison C. Collard; Thomas M. Galgano

[57] ABSTRACT

A portable glazier point driver having a hand grip body with a rear leg portion and a front leg portion and a pivotable handle mounted to the body and coupled to a spring loaded plunger for moving the plunger back and forth across a magazine barrel for dispensing glazier points. The front leg portion includes a cylindrical bore for receiving a variety of cylindrical barrel magazines so that glazier points of different shapes and sizes can be accommodated in the driver. The barrel-shaped magazine which fits into the cylindrical bore includes a longitudinal slot so that the slot can be aligned to a set screw in the front leg portion and the barrel can be locked into place. The set screw is necessary and the lineup is important so that the centerline is matched with each cylinder.

6 Claims, 8 Drawing Figures

GLAZIER'S POINT DRIVER

This invention relates to a portable, hand-operated device for driving glaziers' points into window sashes and picture frames for holding into place the panes of glass or plastic in said frames.

More specifically, the invention relates to an improved portable, hand-operated glazier point driving device, which includes an interchangeable magazine or feed-barrel, so that different types of glazier points can be utilized with the same driving tool.

In glazier point drivers of the prior art, such as those shown in U.S. Pat. Nos. 1,134,334 and 1,744,700, it is impossible to utilize glazier points of different sizes in the same driver, since the feed device or magazine is integrally formed in the casting or body of the handle. Thus, with the above-mentioned conventional glazier point drivers, an individual driving tool must be secured for each type of glazier point used.

Accordingly, the present invention overcomes many of the disadvantages of the prior art drivers, by providing a glazier point driver which has an insertable magazine or barrel, and which can be interchanged so as to accommodate a large variety of sizes and shapes of glazier points. The barrel is inserted into an opening in the forward part of the body of the driver, and retained in place by means of a setscrew engaging a slot. The device of the present invention employs a plunger connected to a driver plate, which can accommodate a large number of different sizes of glazier points, so that they can be driven into a frame member.

Accordingly, it is an object of the present invention to provide a glazier point driver, which is capable of using glazier points of different sizes and shapes.

It is another object of the present invention to provide a glazier point driver which is simple in design, easy to manufacture and reliable in operation.

Other objects and features of the present invention will become apparent from the following detailed description considered in connection with the accompanying drawings, which show the embodiments of the invention. It is to be understood that the drawings are designed for the purpose of illustration, and not as a definition of the limits of the invention.

In the drawings, wherein similar references characters denote similar elements throughout the several views.

Figure 1:
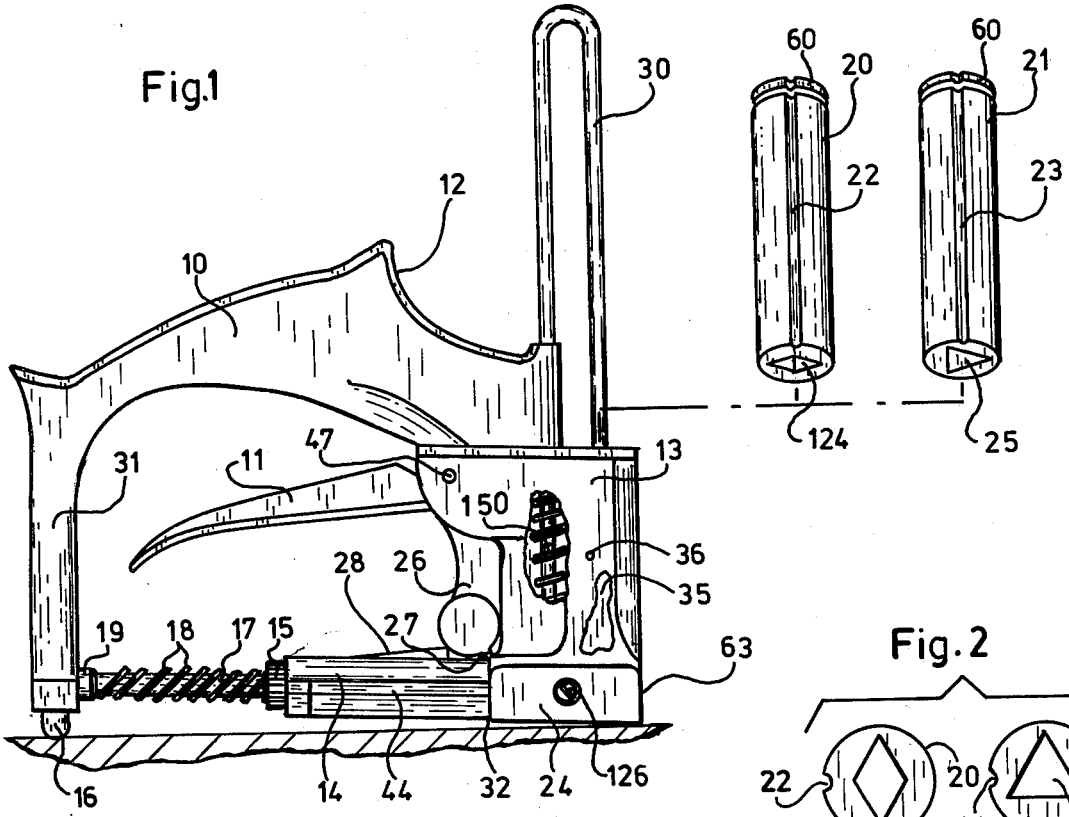
FIG. 1 is a side plan view, showing the body of the glazier point driver and its insertable barrels, according to the invention.
Figure 2:
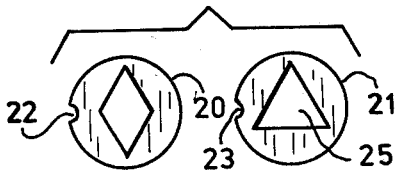
FIG. 2 is a top view of the barrels of FIG. 1.
Figure 4:
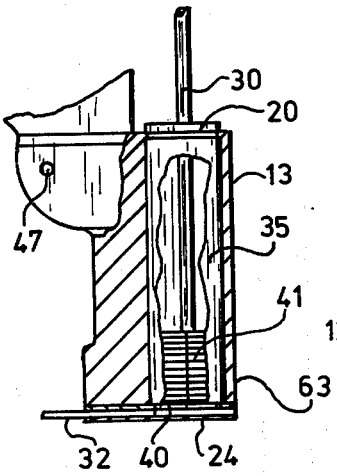
FIG. 4 is a side view, partly in cross-section, of the barrel retained in place in the hand-grip.
Figure 3:
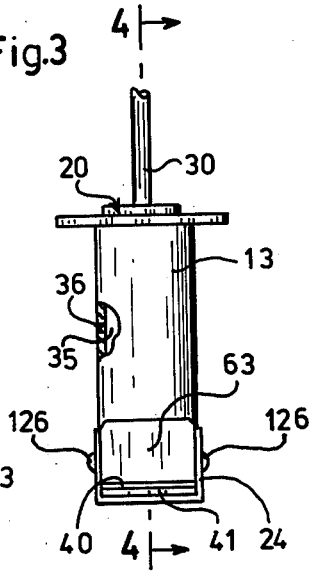
FIG. 3 is a front view of the barrel inserted into the device.

Referring to FIG. 1, there is shown a plan view partly in cross section of the glazier point driver having a body 10 preferably cast of light-weight metal and provided with an integrally formed rear leg portion 31 and a front leg portion 13. The rear leg portion 31 terminates in a pair of feet 16 which are spaced apart in a triangular portion of the rear leg so that the tool can stand up vertically. The driver also includes a pivotably supported handle 11 disposed within its center portion, and a thumb grip 12. The handle pivots about bearing 47 mounted in the front leg and includes a lever arm 26 which is designed to grip and compress a plunger 14 against a spring 18 in order to drive glazier points into frame areas. As shown in more detail in FIG. 3 and 4, front leg 13 also includes a vertical cylindrical bore 35 for receiving one or more magazine barrels 20 or 21 within the cylindrical bore. The magazine barrels preferably include a longitudinal slot 22 or 23 which when inserted in bore 35 can be swiveled into alignment with set screw 36 which is threadably coupled through opening 37 in front leg 13. The set screw prevents the magazine barrel from swiveling once it has been inserted into bore 35. Each barrel preferably includes an upper rim 60 to allow the user to easily grip the top of the barrel, thereby permitting easy removal thereof.

Figure 5:
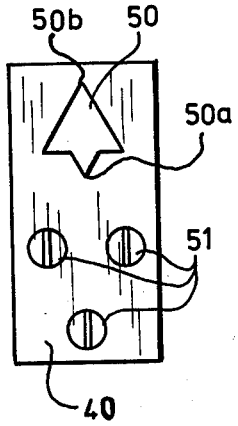
FIG. 5 is a plan view of the adapter plate of the invention.

Front leg 13 also includes a U-shaped follower 30 which is spring-loaded by means of spring 150 so that it presses downwardly within the diamond-shaped or triangular openings 124 or 25 in barrels 21 or 22. Follower 30, as shown in detail in FIG. 4 applies pressure against glazier points 41 so that they are urged through an opening 50 in adaptor plate 40 secured at the base of foot 13 as shown in detail in FIGS. 3 and 5. Adaptor plate 40 of FIG. 5 also includes several openings in order to accommodate flush screws for securing the adaptor plate to the bottom of leg 13.

Opening 50 in adaptor plate 40 is designed as a large triangle interrupted by a small, inverted triangle on one side thereof in order to allow the passage of both diamond-shaped and triangular-shaped points depending on which barrel and set of points are utilized in the driving tool. The large triangular-shape of opening 50 is preferably sufficiently large to accommodate the largest of the triangular points used in the driver while the distance between end points 50*a* and 50*b* is made sufficiently large to accommodate the largest of the diamond-shaped points which will be utilized.

Figure 7:
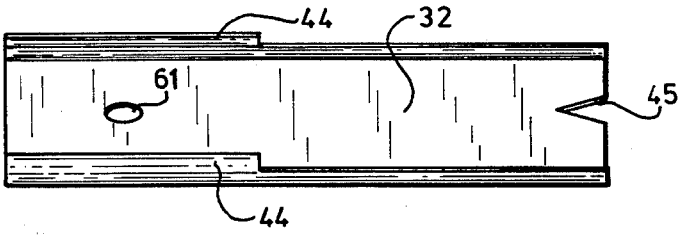
FIG. 7 is a detailed view of the driver plate of the invention.

At one end of plunger 14 directed toward rear leg 31 is secured a threaded shaft 17 which not only accommodates a spiral spring 18 but also a knurled adjusting nut 15 which will be used to adjust the tension of spring 18. Since nut 15 is threadably coupled to shaft 17, the nut can be rotated along the threaded shaft toward the rear leg in order to increase the tension of spring 18 against shaft 17 and thus the tension of the plunger against front leg 13. A slide bushing 19 fitted into an opening in rear leg 31 allows shaft 17 to freely pass through the rear leg as the plunger is repeatedly operated by handle 11, and also retains the end of spring 18. Plunger 14 also includes a driver plate 32 as shown in detail in FIG. 7 which is designed to slide between adaptor plate 40 and base plate 24 at the bottom of front leg 13. Driver plate 32 includes curled edges 41 for gripping against corresponding longitudinal grooves in plunger 14. There is also a screw opening 61 in driver plate 32 to demountably secure the plate to the plunger. The driving edge of driver plate 32 includes a V-shaped notch 45 preferably disposed in the center of the driving edge and having an opening and apex angle approximately equivalent to the apex angle of the smallest of the glazier points to be accommodated by the driver. The thickness of driver plate 32 is approximately equal to the thickness of one glazier point so that as plunger 14 moves the driver plate back and forth across the opening 50 of adaptor plate 40, glazier points fed through the opening will engage into slot 45 of driver plate 32 for transmission into a frame support. The leading surface 63 of leg 13 has been flattened so that it can be firmly pressed against a frame support when the glazier points are being applied. It should be noted that set screw 36 ensures a proper lineup of the centerline of the barrel with slot 45 and opening 50.

The top portion of plunger 14 includes a pivotable lever pivoted on axis 29 and engaged by a compression spring 48 at its one end so that one end of the lever is tipped upwardly toward a finger 27 mounted on the end of handle lever 26.

Figure 6:
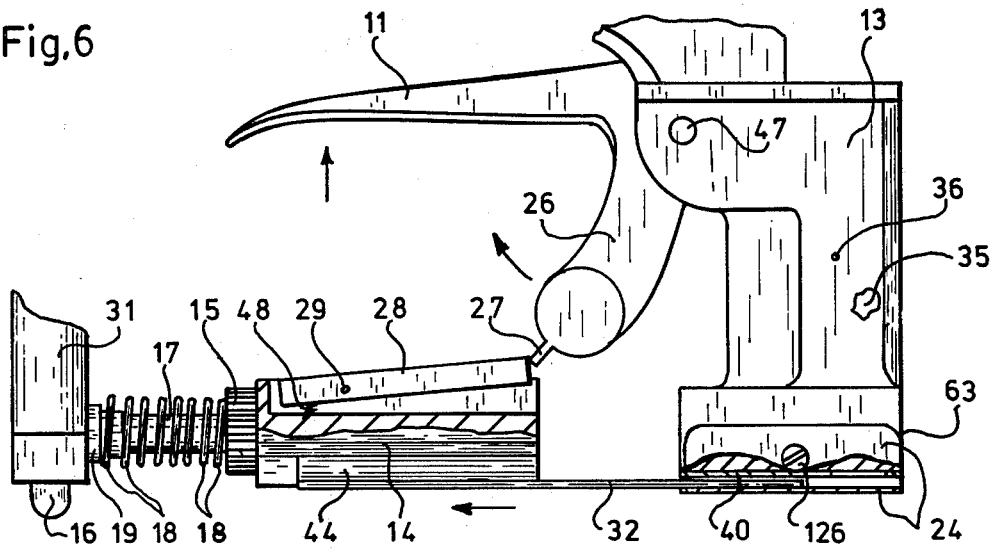
FIG. 6 is a detailed, side plan view of the driver, prior to the plunger being activated.
Figure 8:
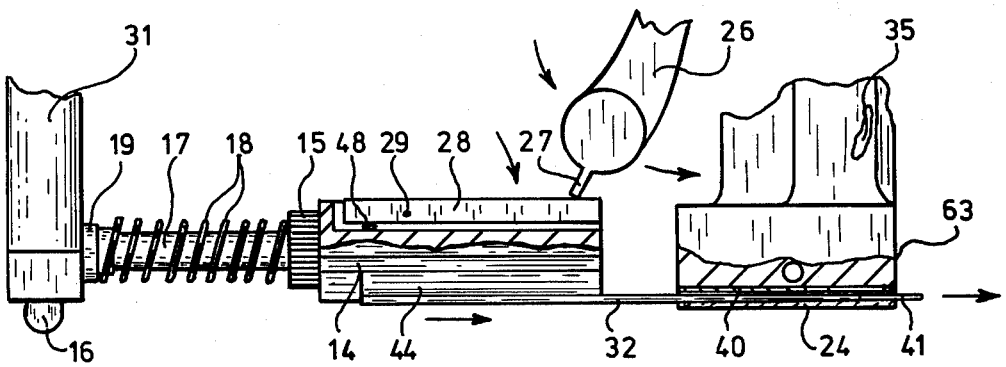
FIG. 8 is a further view of the invention of FIG. 6, after the plunger has been activated.

As the handle is squeezed upwardly as shown in detail in FIG. 6, finger 27 engages the raised edge of lever 28 and causes plunger 14 and driver plate 32 to slide against the compression of spring 18 toward rear leg 31. Since handle 11 is held fixed in its pivotable arc by means of axis 47, finger 27 will soon disengage the front edge of lever 28 as shown in FIG. 8 so as to release the plunger and allow lever 28 to drop downwardly. The force of spring 18 will then cause the plunger to jump back into position against front leg 13 and at the same time force driver plate 32 against the next glazier point causing it to shoot out of the front opening of base plate 24.

Base plate 24 is a U-shaped member and is secured to the end of front leg 13 by means of a pair of threaded screws 126 engaging its parallel side flaps.

One can appreciate that it is easy to change barrels in the inventive device by merely releasing set screw 36 and raising follower 30 so that the barrel can be lifted out of cylindrical bore 35 in the front leg and a new barrel inserted.

While only a few embodiments of the present invention have been shown and described, it will be obvious that many changes and modifications may be made thereto without departing from the spirit and scope of the invention.

What is claimed is:

1. In a glazier point driver having a hand grip body with a rear leg portion and a front leg portion, and a pivotable handle in the body portion coupled to a spring loaded plunger, the improvement comprising:

a driver plate connected to said plunger and having at its driving end a V-shaped notch;

a cylindrical bore formed in said front leg portion communicative to said driver plate;

a cylindrical barrel disposed in said cylindrical bore;

means for aligning and securing said barrel in said bore; and an adaptor plate having a combination diamond-shaped and triangularly-shaped opening for receiving diamond-shaped and triangularly-shaped points.

2. The glazier point driver as recited in claim 1, wherein said barrel includes at least one longitudinal slot and screw means for securing the barrel to the front leg portion in contact with said slot.

3. The glazier point driver as recited in claim 2, wherein said screw means comprises a set screw disposed in said front leg portion and having an axis perpendicular to said barrel and engaging the longitudinal slot after said barrel is inserted into the cylindrical bore.

4. The glazier point driver as recited in claim 3, wherein said barrel additionally comprises a rim formed at one end for permitting alignment of the barrel with respect to the front leg portion.

5. The glazier point driver as recited in claim 4, wherein said barrel includes a triangularly-shaped bore for receiving triangular glazier points.

6. The glazier point driver as recited in claim 4, wherein said barrel includes a diamond-shaped bore for receiving diamond-shaped glazier points.

* * * * *